US007431572B2

(12) United States Patent
Hoffarth

(10) Patent No.: US 7,431,572 B2
(45) Date of Patent: Oct. 7, 2008

(54) HYDRAULIC OIL WELL PUMPING INSTALLATION

(75) Inventor: Clayton Hoffarth, Breton (CA)

(73) Assignee: Global Energy Services Ltd., Calgary (CA)

( * ) Notice: Subject to any disclaimer, the term of this patent is extended or adjusted under 35 U.S.C. 154(b) by 492 days.

(21) Appl. No.: 11/045,732

(22) Filed: Jan. 28, 2005

(65) Prior Publication Data

US 2005/0150224 A1 Jul. 14, 2005

(51) Int. Cl.
*F04B 35/02* (2006.01)
*F04B 53/12* (2006.01)
*F04B 47/04* (2006.01)

(52) U.S. Cl. ..... 417/403; 417/259; 417/264; 417/399; 417/401; 417/548; 417/555.2

(58) Field of Classification Search ..... 417/399, 417/401, 403, 404, 548, 254, 259, 264, 555.2
See application file for complete search history.

(56) References Cited

U.S. PATENT DOCUMENTS 2,261,752 A 11/1941 Buckner
2,841,086 A * 7/1958 Deitrickson ..... 417/403
4,334,833 A * 6/1982 Gozzi ..... 417/258
5,104,296 A 4/1992 Roeder
5,651,666 A 7/1997 Martin
5,807,082 A 9/1998 Skinner et al.
6,193,476 B1 * 2/2001 Sweeney ..... 417/401

FOREIGN PATENT DOCUMENTS

WO WO 98/55766 12/1998

* cited by examiner

*Primary Examiner*—Devon Kramer
*Assistant Examiner*—Philip Stimpert
(74) *Attorney, Agent, or Firm*—Christensen O'Connor Johnson Kindness PLLC

(57) ABSTRACT

A hydraulic oil well pumping installation includes a down hole pump positioned down a well, the down hole pump including a master cylinder and at least one slave cylinder in axial alignment with the master cylinder. A master piston is positioned in the master cylinder and divides the master cylinder into a first portion and a second portion. A slave piston is positioned in the at least one slave cylinder and divides the slave cylinder into a first portion and a second portion. The slave piston is connected by a rigid linkage to the master piston, such that movement of the master piston results in movement of the slave piston.

3 Claims, 3 Drawing Sheets

HYDRAULIC OIL WELL PUMPING INSTALLATION

FIELD OF THE INVENTION

The present invention relates to an oil well pumping installation suitable for wells having a low flow rate.

BACKGROUND OF THE INVENTION

U.S. Pat. No. 2,841,086 (Deitrickson 1958) discloses a form of hydraulic oil well pumping installation. The Deitrickson pump has not been in use for many years as it was supplanted by other technologies. However, the increased use of coil tubing has made it possible for hydraulic pumps, such as taught by Deitrickson to again be considered.

SUMMARY OF THE INVENTION

What is required is an improved configuration of hydraulic oil well pumping installation.

According to the present invention there is provided a hydraulic oil well pumping installation which includes a down hole pump positioned down a well, the down hole pump including a master cylinder and at least one slave cylinder in axial alignment with the master cylinder. A master piston is positioned in the master cylinder and divides the master cylinder into a first portion and a second portion. A slave piston is positioned in the at least one slave cylinder and divides the slave cylinder into a first portion and a second portion. The slave piston is connected by a rigid linkage to the master piston, such that movement of the master piston results in movement of the slave piston. A first hydraulic fluid conduit selectively supplying hydraulic fluid to and drawing hydraulic fluid from the first portion of the master cylinder. A second hydraulic fluid conduit selectively supplying hydraulic fluid to and drawing hydraulic fluid from the second portion of the master cylinder. An intake port is provided on the at least one slave cylinder. The intake port has a one way intake valve permitting entry of well fluids from the well into the at least one slave cylinder via the intake port and preventing well fluids from exiting the at least one slave cylinder via the intake port. An exhaust port on the at least one slave cylinder connected by conduit to surface, the exhaust port being controlled by a one way exhaust valve permitting well fluids from the well to exit the at least one slave cylinder via the exhaust port and preventing well fluids from the conduit to surface from flowing back into the at least one slave cylinder.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
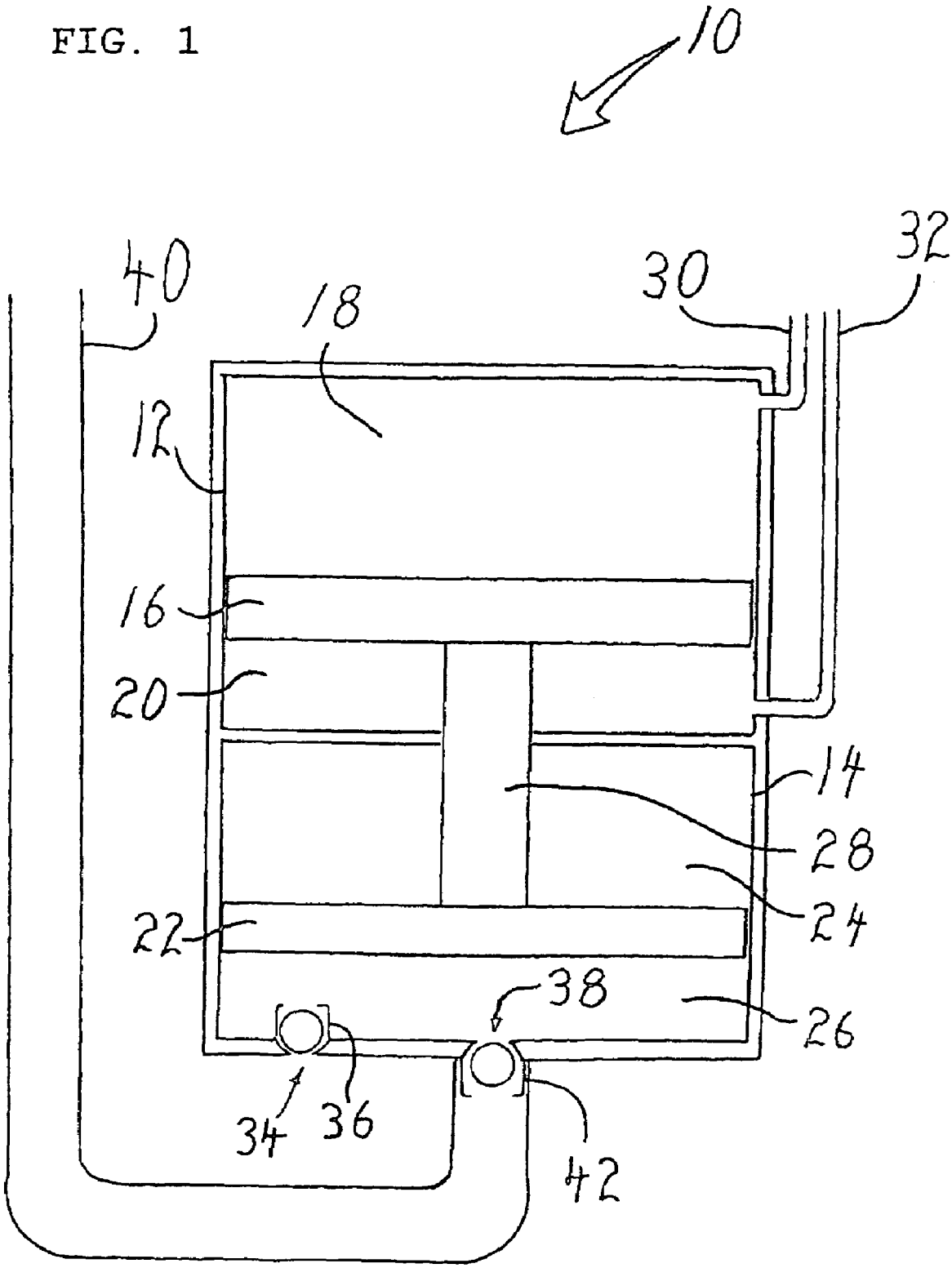
FIG. 1 is a side elevation view in section of a hydraulic oil well pumping installation which includes a pump constructed in accordance with the teachings of the present invention.
Figure 2:
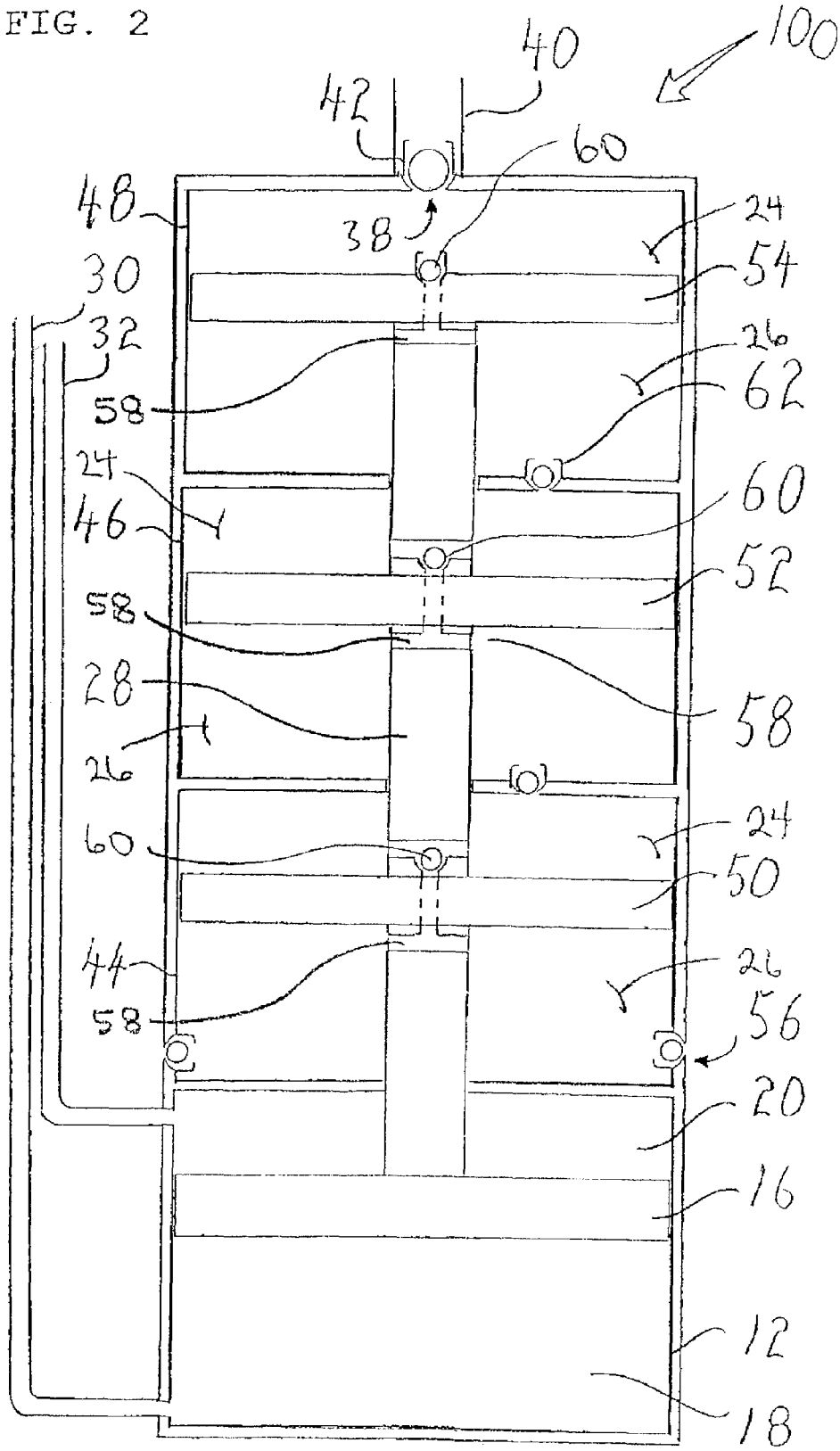
FIG. 2 is a side elevation view in section of a hydraulic oil well pumping installation which includes a pump with multiple slave cylinders.

The preferred embodiment, a hydraulic oil well pumping installation, generally identified by reference numeral 10, will now be described with reference to FIGS. 1 through 3.

Figure 3:
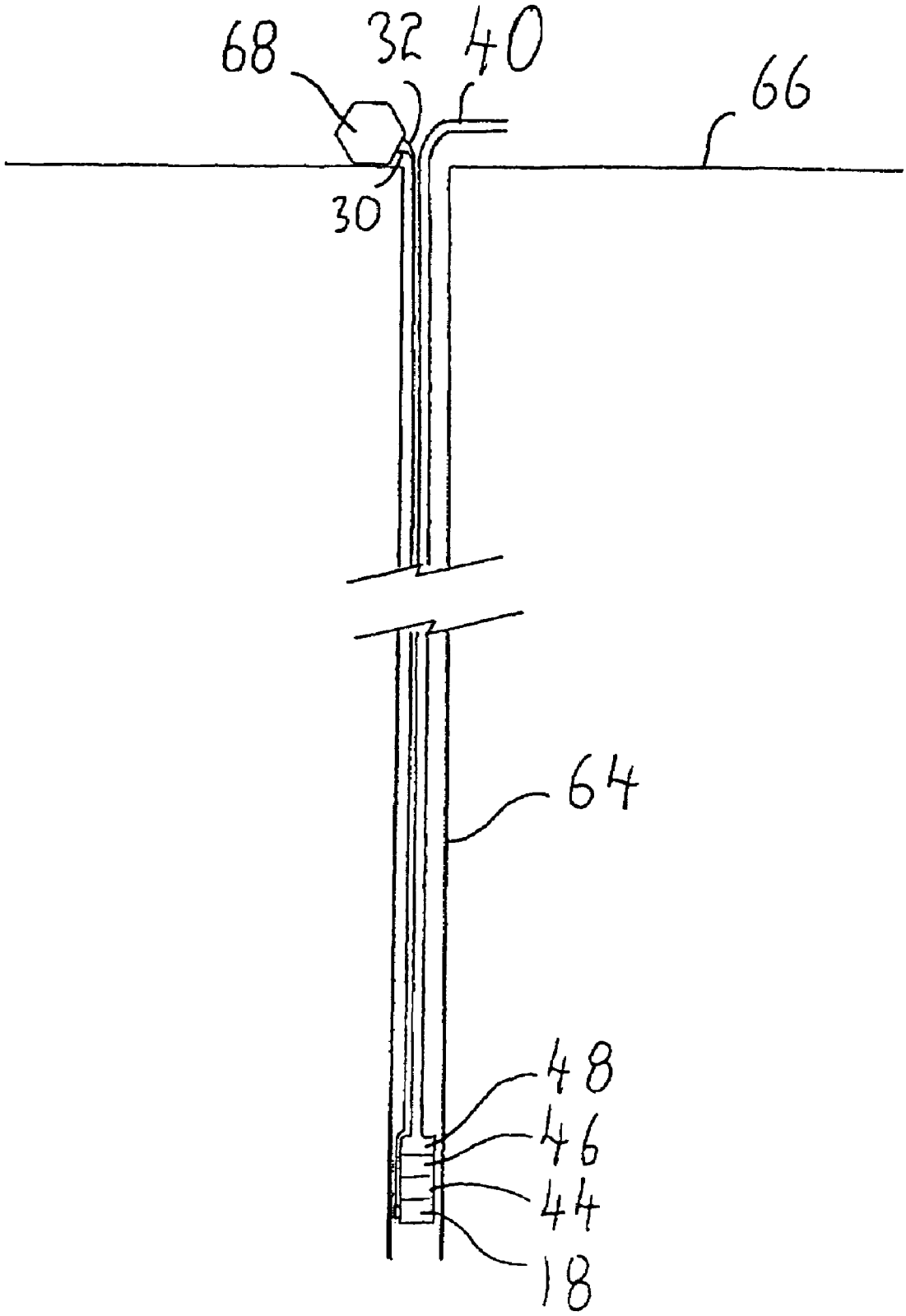
FIG. 3 is a side elevation view of a hydraulic oil well pumping installation which includes a pump down a well.

Structure and Relationship of Parts:

Referring to FIG. 3, a hydraulic oil well pumping installation is illustrated. The key to the operation of hydraulic oil well pumping installation is the pump. Referring to FIG. 1, there is illustrated a pump 10 which has a master cylinder 12 and at least one slave cylinder 14 in axial alignment with master cylinder 12. In the illustrated embodiment, one slave cylinder 14 is shown. Although only one slave cylinder is shown, it will be understood that there may be several slave cylinders. A master piston 16 is positioned within master cylinder 12 and divides master cylinder 12 into a first portion 18 and a second portion 20. A slave piston 22 is positioned within slave cylinder 14 and divides slave cylinder 14 into a first portion 24 and a second portion 26. Slave piston 22 is connected by a rigid linkage 28 to master piston 16 such that movement of master piston 16 results in movement of slave piston 22. A first hydraulic fluid conduit 30 selectively supplies hydraulic fluid to and draws hydraulic fluid from first portion 18 of master cylinder 12. A second hydraulic fluid conduit 32 selectively supplies hydraulic fluid to and draws hydraulic fluid from second portion 20 of master cylinder 12. An intake port 34 is provided on slave cylinder 14. Intake port 34 has a one way intake valve 36 which permits entry of well fluids from the well into second portion 26 of slave cylinder 14 via intake port 34 and prevents well fluids from exiting slave cylinder 14 via intake port 34. An exhaust port 38 is also provided on second portion 26 of slave cylinder 14 and is connected to exit conduit 40. Exhaust port 38 is controlled by a one way exhaust valve 42 which permits well fluids in second portion 26 of slave cylinder 14 to exit slave cylinder 14 via exhaust port 38 and prevents well fluids from exit conduit 40 from flowing back into slave cylinder 14. Referring to FIG. 3, installation 10 is installed in a well 64 and has exit conduit 40 exiting surface 66 and first hydraulic fluid conduit 30 and second hydraulic fluid conduit 32 in fluid connection with a hydraulic drive system 68 positioned at surface.

Operation:

The use and operation of a hydraulic oil well pumping installation which includes a pump, generally identified by reference numeral 10, will now be described with reference to FIGS. 1 through 3. When hydraulic fluids are supplied through conduit 32 to second portion 20 of master cylinder 12, master piston 16 moves in a first direction and hydraulic fluids are exhausted from first portion 18 of master cylinder 12 through conduit 30. When hydraulic fluids are supplied through conduit 30 to first portion 18 of master cylinder 12, master piston 16 moves in a second direction and hydraulic fluids are exhausted from second portion 20 of master cylinder 12 through conduit 32. When master piston 16 moves, slave piston 22 moves in the same direction, as slave piston 22 is tied to master piston 16 by rigid linkage 28. When slave piston 22 moves in a first direction, well fluids are drawn into second portion 26 of slave cylinder 14 through intake port 34 and exhaust port 38 remains closed. When slave piston 22 moves in a second direction, one way intake valve 36 on intake port 34 closes and the contents of second portion of slave cylinder 14 are forced to the surface through exhaust port 38. When slave piston 22 resumes movement in the first direction, one way exhaust valve 42 prohibits fluid in exit conduit 40 from returning to second portion of slave cylinder 14 through exhaust port 38.

Variations:

It was previously stated that more than one slave cylinder could be provided. Referring to FIG. 2, down hole pump 100 is constructed with more than one slave cylinder. Well fluid is pumped sequentially from one slave cylinder to another. In order to abbreviate the description, common components as between pump 10 and pump 100 will be assigned the same reference numerals. Pump 100 has a first slave cylinder 44, a second slave cylinder 46 and a third slave cylinder 48. Within first slave cylinder 44 is a first slave piston 50 connected to master piston 16 via rigid linkage 28. Within second slave cylinder 46 is a second slave piston 52 connected to master piston 16 and first slave piston 44 via an extension of rigid linkage 28. Within third slave cylinder 48 is a third slave piston 54 connected to master piston 16, first slave piston 50 and second slave piston 52 via a further extension of rigid linkage 28. Perforations 56 allow well fluids to enter first slave cylinder 44. As will hereinafter be further described, transfer ports 58, sequential check valves 60 and sequential intake valves 62 allow the transfer of fluids from first slave cylinder 44 to second slave cylinder 46 and from second slave cylinder 46 to third slave cylinder 48. Fluids are then forced through exhaust port 38 and into exit conduit 40. One way exhaust valve 42 prohibits fluid from returning from exit conduit 40.

The movement of master piston 16 in pump 100 is identical to that described with reference to pump 10. When hydraulic fluids are supplied through conduit 32 to second portion 20 of master cylinder 12, master piston 16 moves in a first direction and hydraulic fluids are exhausted from first portion 18 of master cylinder 12 through conduit 30. When hydraulic fluids are supplied through conduit 30 to first portion 18 of master cylinder 12, master piston 16 moves in a second direction and hydraulic fluids are exhausted from second portion 20 of master cylinder 12 through conduit 32. The movement of fluids by slave piston in pump 100 differs from that described with respect to pump 10. When slave piston 50 moves in a first direction, well fluids are drawn into second portion 26 of slave cylinder 44 through perforations 56. When slave piston 50 moves in a second direction, the contents of second portion 26 of slave cylinder 44 pass through transfer ports 58 to first portion 24 of slave cylinder 44. When slave piston 50 resumes movement in the first direction, check valve 60 closes blocking transfer ports 58 and well fluids are forced passed intake valve 62 into second portion 26 of slave cylinder 46. When slave piston 52 moves in a second direction, the contents of second portion 26 of slave cylinder 46 pass through transfer ports 58 to first portion 24 of slave cylinder 46. When slave piston 52 resumes movement in the first direction, check valve 60 closes blocking transfer ports 58 and well fluids are forced passed intake valve 62 into second portion 26 of slave cylinder 48. When slave piston 54 moves in a second direction, the contents of second portion 26 of slave cylinder 48 pass through transfer ports 58 to first portion 24 of slave cylinder 48. When slave piston 54 resumes movement in the first direction, check valve 60 closes blocking transfer ports 58 and well fluids are forced to surface through exhaust port 38 and along exit conduit 40. One way exhaust valve 42 prohibits fluid in exit conduit 40 from returning to first portion 24 of slave cylinder 48 through exhaust port 38.

It will be apparent to one skilled in the art that modifications may be made to the illustrated embodiment without departing from the spirit and scope of the invention as hereinafter defined in the Claims.

The invention claimed is:

1. A hydraulic oil well pumping installation, comprising:

a down hole pump positioned down a well, the down hole pump including:

a master cylinder wherein the master cylinder is below the slave cylinders;

more than one slave cylinder in axial alignment with the master cylinder;

a master piston positioned in the master cylinder and dividing the master cylinder into a first portion and a second portion;

a slave piston positioned in each slave cylinder and dividing each slave cylinder into a first portion and a second portion, each slave piston being connected directly or indirectly by a rigid linkage to the master piston, such that movement of the master piston results in movement of the slave pistons;

a first hydraulic fluid conduit selectively supplying hydraulic fluid to and drawing hydraulic fluid from the first portion of the master cylinder;

a second hydraulic fluid conduit selectively supplying hydraulic fluid to and drawing hydraulic fluid from the second portion of the master cylinder;

an intake port on each slave cylinder, each intake port having a one way intake valve permitting entry of fluids into the slave cylinder via the intake port and preventing well fluids from exiting each slave cylinder via the intake port; and an exhaust port on each slave cylinder, each exhaust port being controlled by a one way exhaust valve permitting well fluids from the well to exit each slave cylinder via the exhaust port and preventing fluids from flowing back into each slave cylinder, the fluids being drawn into a first slave cylinder via the intake port, pumped sequentially from one slave cylinder to another, and exhausted by conduit to the surface from a last slave cylinder via the exhaust port.

2. The hydraulic oil well pumping installation as defined in claim 1, wherein transfer ports are provided in the rigid linkage to transfer well fluids from the second portion of one slave cylinder to the first portion of the one slave cylinder, the transfer ports having a check valve which closes to block the transfer ports to permit well fluids to be transferred from the first portion of the one slave cylinder through the intake port and into the second portion of another slave cylinder.

3. An hydraulic pump, comprising:

a master cylinder;

more than one slave cylinder positioned above and in axial alignment with the master cylinder;

a master piston positioned in the master cylinder and dividing the master cylinder into a first portion and a second portion;

a slave piston positioned in each of the slaves cylinder and dividing each of the slave cylinders into a first portion and a second portion, each slave piston being connected by a rigid linkage to the master piston, such that movement of the master piston results in movement of each of the slave pistons;

an intake port into the second portion of a lowermost one of the slave cylinders;

an exhaust port from the first portion of an uppermost one of the slave cylinders;

a common port between each pair of vertically adjacent slave cylinders, by which fluid is exhausted from one of the pair of vertically adjacent slave cylinders and taken into the other of the pair of vertically adjacent slave cylinders; and transfer ports in the rigid linkage to transfer well fluids from the second portion of one slave cylinder to the first portion of the one slave cylinder, the transfer ports having a check valve which closes to block the transfer ports to permit well fluids to be transferred from the first portion of the one slave cylinder through the common port into the second portion of another slave cylinder.

* * * * *

UNITED STATES PATENT AND TRADEMARK OFFICE

CERTIFICATE OF CORRECTION

PATENT NO. : 7,431,572 B2
APPLICATION NO. : 11/045732
DATED : October 7, 2008
INVENTOR(S) : C. Hoffarth It is certified that error appears in the above-identified patent and that said Letters Patent is hereby corrected as shown below:

| COLUMN | LINE | ERROR |
|---|---|---|
| 4 (Claim 3, | 53 line 8) | "slaves cylinder" should read --slave cylinders-- |

Signed and Sealed this

Twenty-eighth Day of July, 2009

John Doll

JOHN DOLL
*Acting Director of the United States Patent and Trademark Office*